US008993909B2

(12) United States Patent
Chang et al.

(10) Patent No.: US 8,993,909 B2
(45) Date of Patent: Mar. 31, 2015

(54) BUTTON STRUCTURE

(71) Applicants: Inventec (Pudong) Technology Corporation, Shanghai (CN); Inventec Corporation, Taipei (TW)

(72) Inventors: Yuan-Jui Chang, Taipei (TW); Cheng-Hsin Chen, Taipei (TW); Shih-Jung Huang, Taipei (TW); Yao-Yu Lai, Taipei (TW)

(73) Assignees: Inventec (Pudong) Technology Corporation, Shanghai (CN); Inventec Corporation, Taipei (TW)

( * ) Notice: Subject to any disclaimer, the term of this patent is extended or adjusted under 35 U.S.C. 154(b) by 158 days.

(21) Appl. No.: 13/783,411

(22) Filed: Mar. 4, 2013

(65) Prior Publication Data

US 2014/0116864 A1 May 1, 2014

(30) Foreign Application Priority Data

Oct. 29, 2012 (CN) ..... 2012 1 0421587

(51) Int. Cl.
*H01H 1/64* (2006.01)
*H01H 9/02* (2006.01)

(52) U.S. Cl.
CPC ..... *H01H 9/02* (2013.01)
USPC ..... 200/290

(58) Field of Classification Search
USPC ..... 200/293, 341
IPC ..... H01H 13/04,13/12, 13/14
See application file for complete search history.

(56) References Cited

U.S. PATENT DOCUMENTS

| | | | | |
|---|---|---|---|---|
| 6,160,232 | A * | 12/2000 | Lin | 200/341 |
| 6,791,046 | B1 * | 9/2004 | King | 200/293 |
| 7,217,897 | B2 * | 5/2007 | Mattarelli | 200/329 |
| 8,247,718 | B2 * | 8/2012 | Mao et al. | 200/296 |
| 8,331,107 | B2 * | 12/2012 | Ouyang | 361/807 |
| 8,367,954 | B2 * | 2/2013 | Mao et al. | 200/314 |
| 8,546,714 | B2 * | 10/2013 | Zhang et al. | 200/344 |
| 2011/0036693 | A1 * | 2/2011 | Lin et al. | 200/314 |

* cited by examiner

*Primary Examiner* — Vanessa Girardi
(74) *Attorney, Agent, or Firm* — CKC & Partners Co., Ltd.

(57) ABSTRACT

A button structure is provided and includes a support bracket and a button. The support bracket has two opposite edges, a first concave portion, a second concave portion, and a position limiting protruding point. The first and second concave portions are respectively located at the two opposite edges, and the position limiting protruding point protrudes from the second concave portion. The button is located on the support bracket and includes a body portion, two neck portions and two stop portions. The two neck portions are located on two opposite ends of the body portion, and are respectively coupled to the first and second concave portions. The neck portion coupled to the second concave portion is positioned by the position limiting protruding point. The two stop portions are respectively connected to a side of the two neck portions facing away from the body portion.

9 Claims, 7 Drawing Sheets

BUTTON STRUCTURE

RELATED APPLICATIONS

This application claims priority to China Application Serial Number 201210421587.4, filed Oct. 29, 2012, which is herein incorporated by reference.

BACKGROUND

1. Field of Invention

The invention relates to a button structure.

2. Description of Related Art

As the technology of the consumer electronics is developing quickly, for the server, the desktop computer, the notebook computer, the tablet computer, the smart phone, the video camera, the camera or the video tape recorder, the demands for various storage devices become higher and higher. It is required to configure a proper input device on the above electronics as operated by a user, such as a mouse, a keyboard, a button and a touch screen, which is designed according to the designer's demands.

Although recently the ratio of the electronics using the touch screen as the input device has been become higher and higher, since physical buttons are direct viewing for users, can be operated quickly and can provide hand handle for users when being pressed, it is necessary to configure the physical buttons. For example, a power switch of the electronics, a camera shutter key and a volume adjustment key still employ the physical buttons mostly. A conventional button is connected to the inner surface of a shell. The shell has a hollow area at a position corresponding to the button, such that the button can be revealed in the hollow area of the shell.

However, the button is easy to fall off if hot melting process is not made during assembly between the button and the shell. Therefore, it is easy to cause button shift during the assembly, such that it is not easy for the button to align with the hollow area of the shell and a pressure sensitive element of the printed circuit board. Additionally, although the hot melting process can ensure the button is fixed in a particular position of the shell, the hot melting process is time-consuming and laborious, and the connection between the button and the shell is easy to be broken after being used for a period of time. That is, the conventional button is difficult to be assembled and firmly connected with the shell or the printed circuit board, and thus the human cost is increased.

SUMMARY

An aspect of the invention provides a button structure.

According to an embodiment of the invention, a button structure includes a support bracket and a button. The support bracket has two opposite edges, a first concave portion, a second concave portion, and a position limiting protruding point. The first and second concave portions are respectively located at the two opposite edges, and the position limiting protruding point protrudes from the second concave portion. The button is located on the support bracket and includes a body portion, two neck portions and two stop portions. The two neck portions are located on two opposite ends of the body portion, and the length direction of each of the two neck portions is perpendicular to the length direction of the body portion. The two neck portions are respectively coupled to the first and second concave portions. The neck portion coupled to the second concave portion is positioned by the position limiting protruding point. The two stop portions are respectively connected to a side of the two neck portions facing away from the body portion. The external diameter of each of the two stop portions is larger than the external diameter of the corresponding neck portion, such that the two stop portions can abut against the support bracket.

In another embodiment of the invention, the above button structure further includes a flexible printed circuit board. The flexible printed circuit board is fixed on the support bracket and has at least one pressure sensitive element. The pressure sensitive element is located between the support bracket and the body portion of the button. When the body portion of the button is pressed, the body portion contacts the pressure sensitive element, such that the pressure sensitive element transfers a pressure sensitive signal.

In an embodiment of the invention, the length of each of the above neck portions is greater than the thickness of the support bracket.

In an embodiment of the invention, the above button structure further includes at least one elastomer. The elastomer is located between the support bracket and the body portion of the button and located between the two neck portions.

In an embodiment of the invention, the above elastomer includes sponge, rubber or spring.

In an embodiment of the invention, the above second concave portion has a slope surface, and the position limiting protruding point is located on the slope surface.

In an embodiment of the invention, the above support bracket further includes a fixing arm. The length direction of the fixing arm is in parallel with the length direction of each of the two neck portions, and has a throughhole for penetration of a fixing element.

In an embodiment of the invention, the above button structure further includes a printed circuit board. The printed circuit board is connected to the fixing arm, and has a fixing hole aligned with the throughhole of the fixing arm so as to engage the fixing element into the fixing hole.

In an embodiment of the invention, the above support bracket has at least one hollow portion. The hollow portion is located between the first and second concave portions. The body portion of the button has at least one protruding portion which penetrates the hollow portion. The printed circuit board has at least one pressure sensitive element which is aligned with the protruding portion. When the body portion of the button is pressed, the protruding portion contacts the pressure sensitive element, such that the pressure sensitive element transfers a pressure sensitive signal.

In an embodiment of the invention, the length direction of the above protruding portion is in parallel with the length direction of each of the two neck portions.

In the above embodiments of the invention, the button is located on the support bracket. When the two neck portions of the button are coupled to the first and second concave portions of the support bracket respectively, the neck portion coupled to the second concave portion is positioned by the position limiting protruding point that protrudes from the second concave portion. Furthermore, the external diameter of the stop portion connected to the neck portion is larger than the external diameter of the neck portion. When the two neck portions of the button are shaken due to an external force in the first and second concave portions, the stop portion can abut against the support bracket to prevent the button departing from the support bracket.

Thus, the button and the support bracket can be connected firmly without the hot melting process. During assembly of the button structure, the button may be easily coupled to the first and second concave portions of the support bracket by the two neck portions, such that the button is aligned with the pressure sensitive element. Furthermore, since the hot melting process is omitted during the assembly of the button structure, the time and human cost can be reduced in assembly. After being used for a period of time, since no hot melting area is configured between the button and the support bracket, the button structure is not easy to be broken, so that the service life of the button structure can be lengthened.

DETAILED DESCRIPTION

Figure 1:
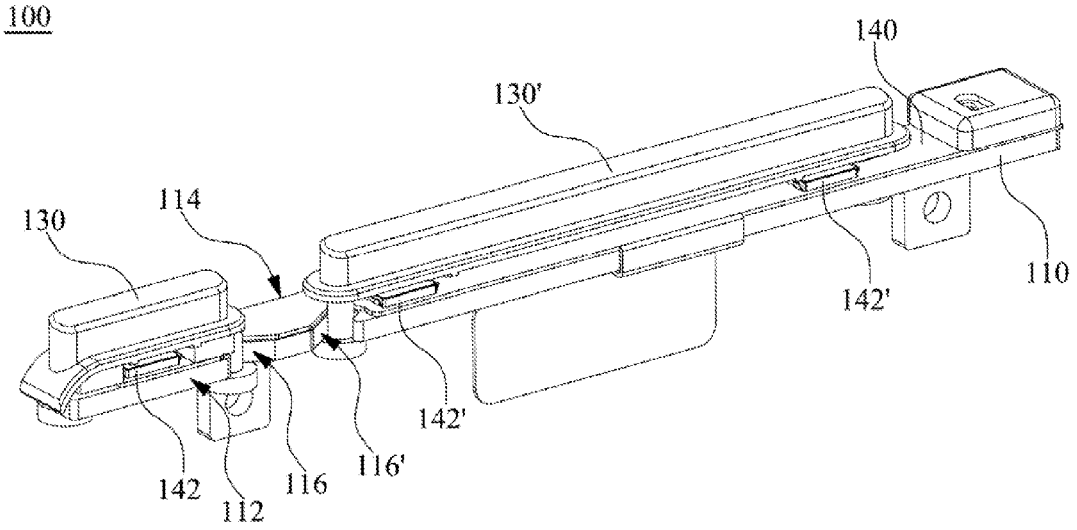
FIG. 1 is a perspective view of a button structure according to an embodiment of the invention.

A plurality of embodiments of the invention will be disclosed below with reference to drawings. For purpose of clear illustration, many details in practice will be described together with the following description. However, it should be understood that, these details in practice are not used for limiting the invention. That is, in some embodiments of the invention, these details in practice are not necessary. Furthermore, for purpose of simplifying drawings, some conventional structures and components will be shown schematically in the drawings.

Figure 2:
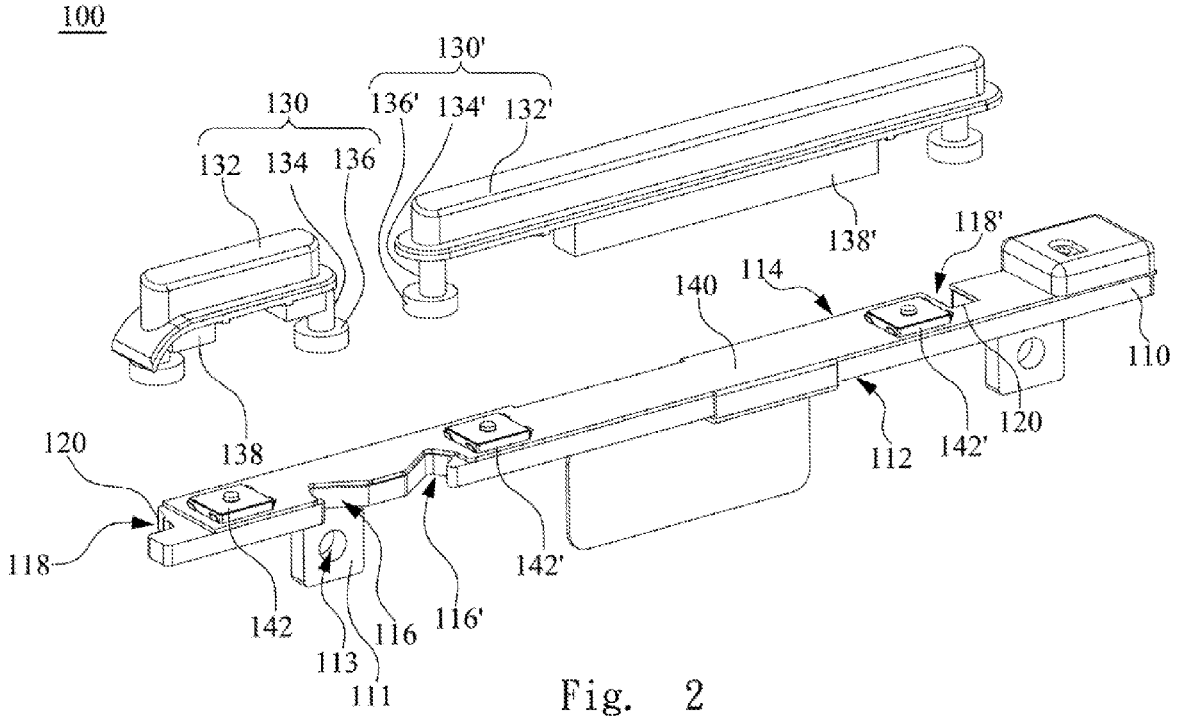
FIG. 2 is an exploded diagram of the button structure of FIG. 1.

FIG. 1 is a perspective view of a button structure 100 according to an embodiment of the invention. FIG. 2 is an exploded diagram of the button structure 100 of FIG. 1. Referring both FIGS. 1 and 2, the button structure 100 includes a support bracket 110 and buttons 130, 130'. The shorter button 130 is for example a power button of a mobile phone, and the longer button 130' is for example a volume adjustment key of the mobile phone, but the invention is not limited to this. In the following description, a structure for connecting the button 130 and the support bracket 110 to each other will be described.

The support bracket 110 has two opposite edges 112, 114, a first concave portion 116, a second concave portion 118 and a position limiting protruding point 120. The first and second concave portions 116, 118 are respectively located at the two opposite edges 112, 114, and the position limiting protruding point 120 protrudes from the second concave portion 118. The button 130 is located on the support bracket 110 and includes a body portion 132, two neck portions 134 and two stop portions 136. The two neck portions 134 are located on two opposite ends of the body portion 132, and the length direction of each of the two neck portions 134 is perpendicular to the length direction of the body portion 132. The two neck portions 134 are respectively coupled to the first and second concave portions 116, 118. The two stop portions 136 are respectively connected to a side of the two neck portions 134 facing away from the body portion 132, such that the two stop portions 136 can abut against the support bracket 110. In this embodiment, the two opposite edges 112, 114 are the opposite edges of two long sides of the support bracket 110.

Furthermore, the button structure 100 further includes a flexible printed circuit board 140. The flexible printed circuit board 140 is fixed on the support bracket 110 and has a pressure sensitive element 142. The pressure sensitive element 142 is located between the support bracket 110 and the body portion 132 of the button 130. When the body portion 132 of the button 130 is pressed, the body portion 132 contacts the pressure sensitive element 142, such that the pressure sensitive element 142 transfers a pressure sensitive signal. This pressure sensitive signal can be transferred to a control unit of a printed circuit board through the flexible printed circuit board 140.

The button structure 100 may further include an elastomer 138. The elastomer 138 is located between the support bracket 110 and the body portion 132 of the button 130 and located between the two neck portions 134. The elastomer 138 may include, but not limited to the sponge, the rubber and the spring. In this embodiment, the elastomer 138 is the sponge. Since the button 130 is located above a single pressure sensitive element 142, the elastomer 138 can be attached to the two opposite ends of the body portion 132. When the user presses the central area of the body portion 132 of the button 130, the central area of the body portion 132 may easily contact the pressure sensitive element 142. When the user stops pressing the body portion 132 of the button 130, the elastomer 138 located on the two opposite ends of the body portion 132 can enable the body portion 132 to depart from the pressure sensitive element 142 to reset.

In the following description, the operation step of assembling the button 130 onto the support bracket 110 is described.

Figure 3:
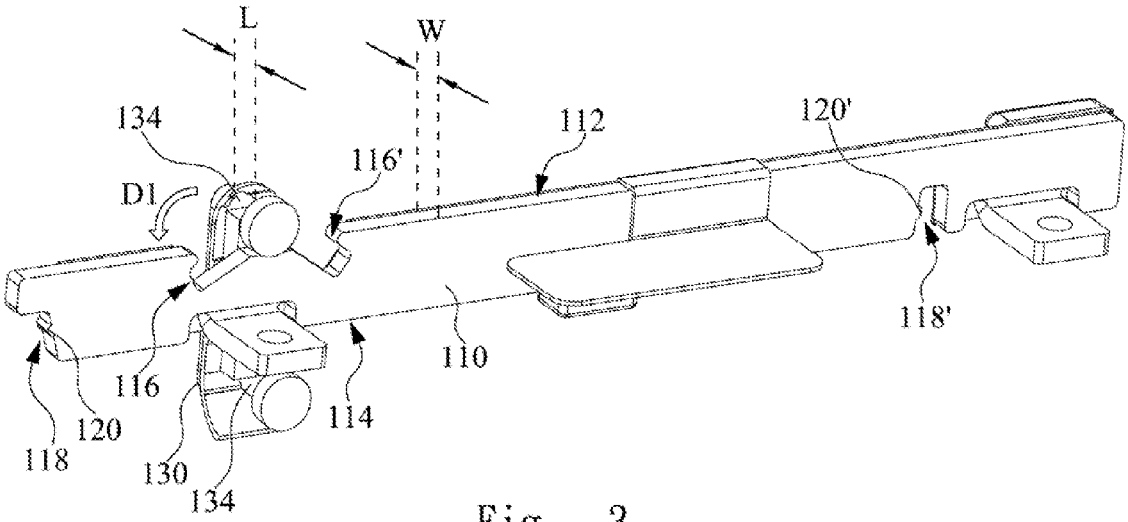
FIG. 3 is a perspective view of one of the two neck portions of the left-side button of FIG. 1 before being assembled to the first concave portion of the support bracket.

FIG. 3 is a perspective view of one of the two neck portions 134 of the left-side button 130 of FIG. 1 before being assembled to the first concave portion 116 of the support bracket 110. The length L of each of the two neck portions 134 is greater than the thickness W of the support bracket 110. The neck portion 134 located in the upper part of FIG. 3 may firstly enter into the first concave portion 116 along a direction D1, such that the neck portion 134 located in the upper part of FIG. 3 is coupled to the first concave portion 116, as shown in FIG. 4.

Figure 4:
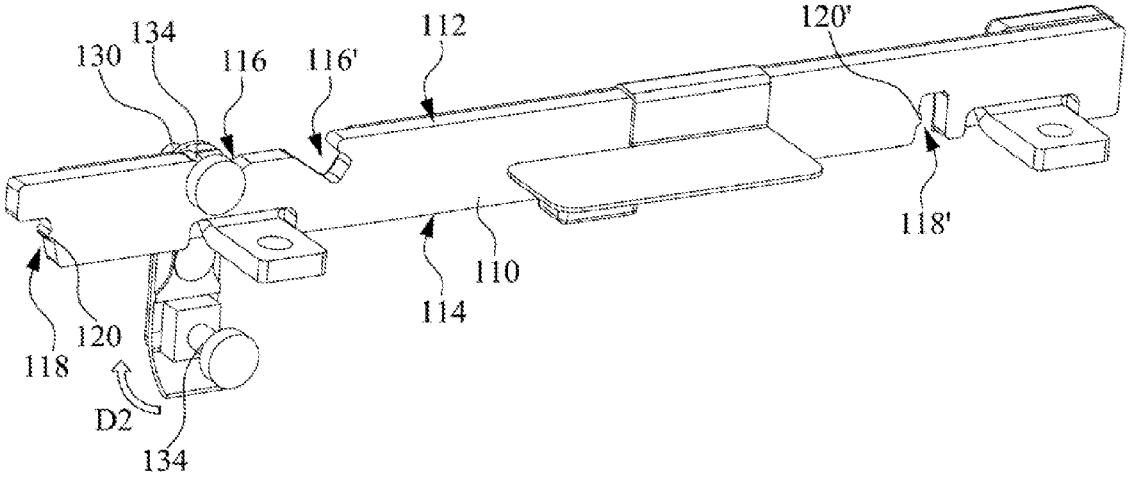
FIG. 4 is a perspective view of one of the two neck portions of the button of FIG. 3 after being assembled to the first concave portion of the support bracket.
Figure 5:
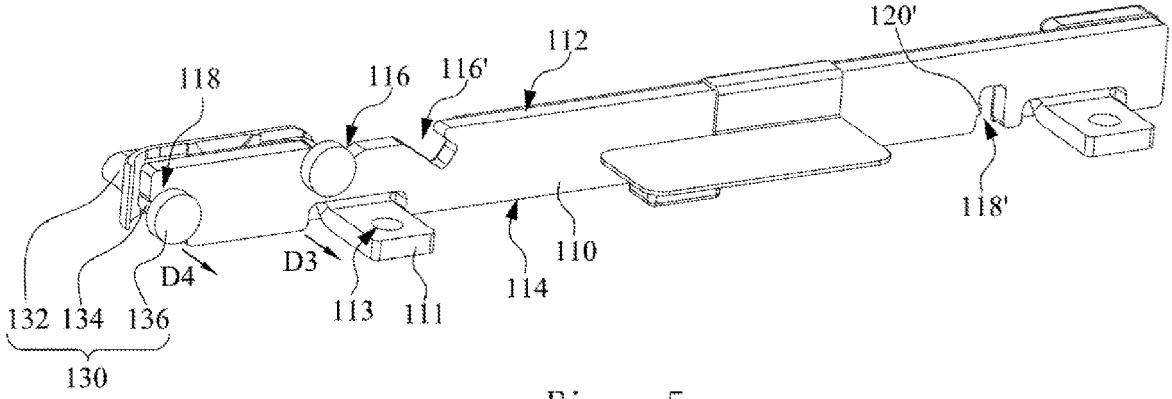
FIG. 5 is a perspective view of the other one of the two neck portions of the button of FIG. 4 after being assembled to the second concave portion of the support bracket.

FIG. 4 is a perspective view of one of the two neck portions 134 of the button 130 of FIG. 3 after being assembled to the first concave portion 116 of the support bracket 110. FIG. 5 is a perspective view of the other one of the two neck portion 134 of the button 130 of FIG. 4 after being assembled to the second concave portion 118 of the support bracket 110. Referring both FIGS. 4 and 5, after the neck portion 134 located in the upper part of FIG. 4 is coupled to the first concave portion 116, the first concave portion 116 can be used as a pivot around which the button 130 pivots. At this time, the neck portion 134 located in the lower part of FIG. 4 may enter into the second concave 118 along a direction D2, such that the neck portion 134 located in the louver part of FIG. 4 is coupled to the second concave portion 118.

In this embodiment, the support bracket 110 may further include a fixing arm 111. The length direction D3 of the fixing arm 111 is in parallel with the length direction D4 of the neck portion 134. The fixing arm 111 has a throughhole 113 for penetration of a fixing element (e.g., a screw), such that the support bracket 110 can be fixed on the printed circuit board or the shell.

Figure 6:
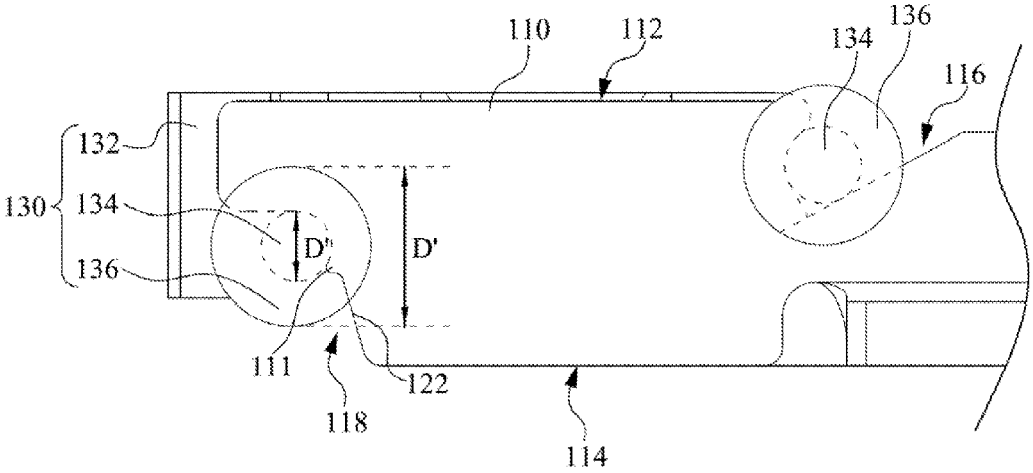
FIG. 6 is a schematic diagram wherein the two neck portions of FIG. 5 are respectively coupled to the first and second concave portions.

FIG. 6 is a schematic diagram wherein the two neck portions 134 of FIG. 5 are respectively coupled to the first and second concave portions 116, 118. Referring both FIGS. 5 and 6, since the position limiting protruding point 120 protrudes from the second concave portion 118, the neck portion 134 coupled to the second concave portion 118 is positioned by the position limiting protruding point 120. Therefore, the button 130 can be firmly assembled on the support bracket 110 and is less susceptible to the external force or gravity to depart from the support bracket 110. Moreover, the external diameter D of the stop portion 136 is larger than the external diameter D of the corresponding neck portion 134, such that the two neck portions 134 of the button 130 do not depart from the first and second concave portions 116, 118 along a direction opposite to the direction D4. In this embodiment, the second concave portion 118 has a slope surface 122. The position limiting protruding point 120 is located on the slope surface 122, such that the neck portion 134 can conveniently slide into the second concave portion 118 through the slope surface 122 and be positioned by the position limiting protruding point 120.

Specifically, the button 130 is located on the support bracket 110. When the two neck portions 134 of the button 130 are respectively coupled to the first and second concave portions 116, 118 of the support bracket 110, the neck portion 134 coupled to the second concave portion 118 is positioned by the position limiting protruding point 120 that protrudes from the second concave portion 118. Furthermore, when the two neck portions 134 of the button 130 are shaken due to the external force in the first and second concave portions 116, 118, the stop portion 136 can abut against the support bracket 110 to prevent the button 130 departing from the support bracket 110.

Referring to FIG. 2 at the same time, the button 130 and the support bracket 110 can be connected firmly without the hot melting process. During assembly of the button structure 100, the button 130 can be easily coupled to the first and second concave portions 116, 118 of the support bracket 110 by the two neck portions 134, such that the button 130 is aligned with the pressure sensitive element 142. Furthermore, since the hot melting process is omitted during the assembly of the button structure 100, the time and human cost can be reduced in assembly. After being used for a period of time, since no hot melting area is configured between the button 130 and the support bracket 110, the button structure 100 is not easy to be broken, so that the service life of the button structure 100 can be lengthened.

It should be understood, the element connection relationship that has been described in the above embodiments will not be described any more. In the following description, it should be noted firstly that, a structure for connecting the button 130' and the support bracket 110 to each other will be described.

Referring both FIGS. 1 and 2, the support bracket 110 has the two opposite edges 112, 114, a first concave portion 116', a second concave portion 118' and a position limiting protruding point 120'. The first and second concave portions 116', 118' are respectively located at the two opposite edges 112, 114, and the position limiting protruding point 120' protrudes from the second concave portion 118'. The button 130' is located on the support bracket 110 and includes a body portion 132', two neck portions 134' and two stop portions 136'. The two neck portions 134 are located on the two opposite ends of the body portion 132', and the length direction of each of the two neck portions 134' is perpendicular to the length direction of the body portion 132'. The two neck portions 134' are respectively coupled to the first and second concave portions 116, 118'. The two stop portions 136' are respectively connected to a side of the two neck portions 134' facing away from the body portion 132', such that the two stop portions 136' can abut against the support bracket 110.

Furthermore, the flexible printed circuit board 140 further has two pressure sensitive elements 142'. The button structure 100 may further include an elastomer 138'. Since the button 130' is located above the two pressure sensitive elements 142' and the two pressure sensitive elements 142' may have different functions (for example, the functions of increasing volume and decreasing volume), a single elastomer 138' may be attached into the central area of the body portion 132'. When the user presses any end of the body portion 132' of the button 130', the body portion 132' can easily contact the corresponding pressure sensitive element 142'. When the user stops pressing the body portion 132' of the button 130', the elastomer 138' located in the central area of the body portion 132' can enable the body portion 132' to depart from the pressure sensitive element 142' to reset.

In the following description, the operation step of assembling the button 130' onto the support bracket 110 is described.

Figure 7:
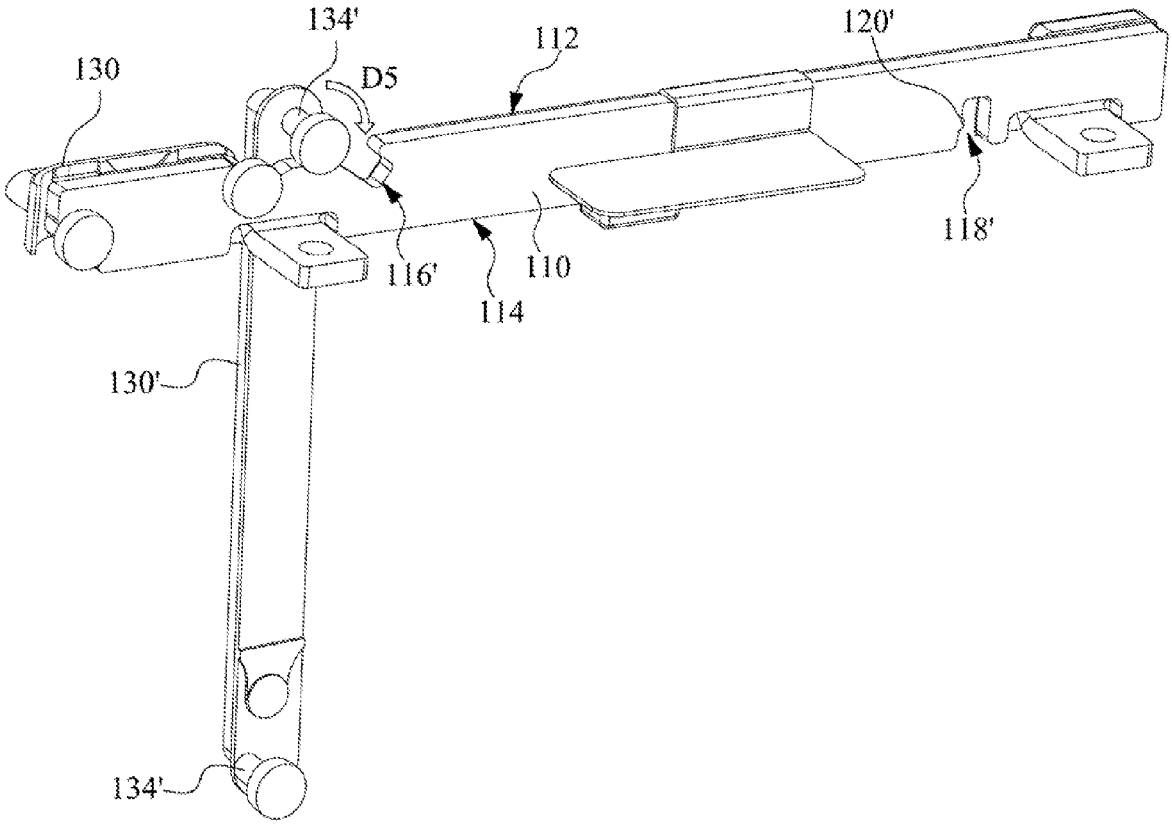
FIG. 7 is a perspective view of one of the two neck portions of the right-side button of FIG. 1 before being assembled to the first concave portion of the support bracket.

FIG. 7 is a perspective view of one of the two neck portions 134 of the right-side button 130 of FIG. 1 before being assembled to the first concave portion 116' of the support bracket 110. The neck portion 134' located in the upper part of FIG. 7 may firstly enter into the first concave portion 116' along a direction D5, such that the neck portion 134' is coupled to the first concave portion 116', as shown in FIG. 8.

Figure 8:
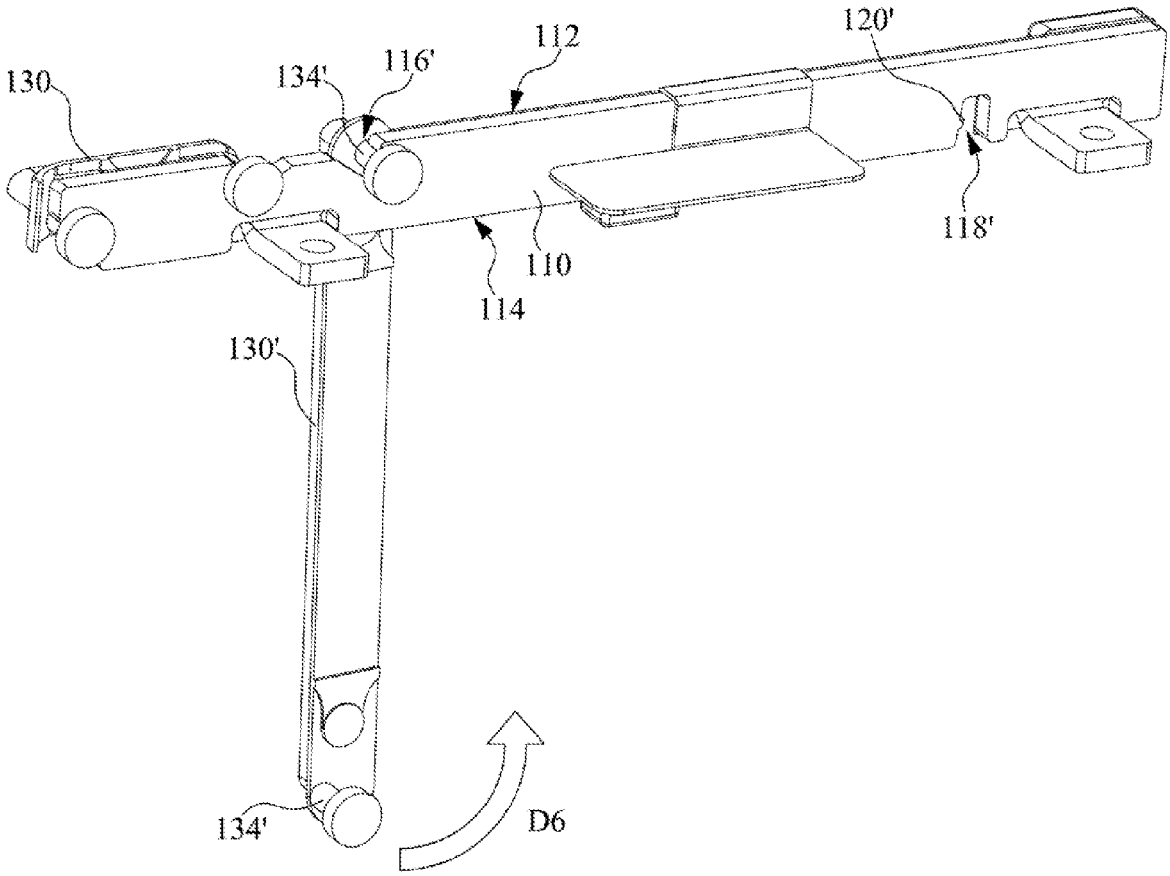
FIG. 8 is a perspective view of one of the two neck portions of the right-side button of FIG. 7 after being assembled to the first concave portion of the support bracket.
Figure 9:
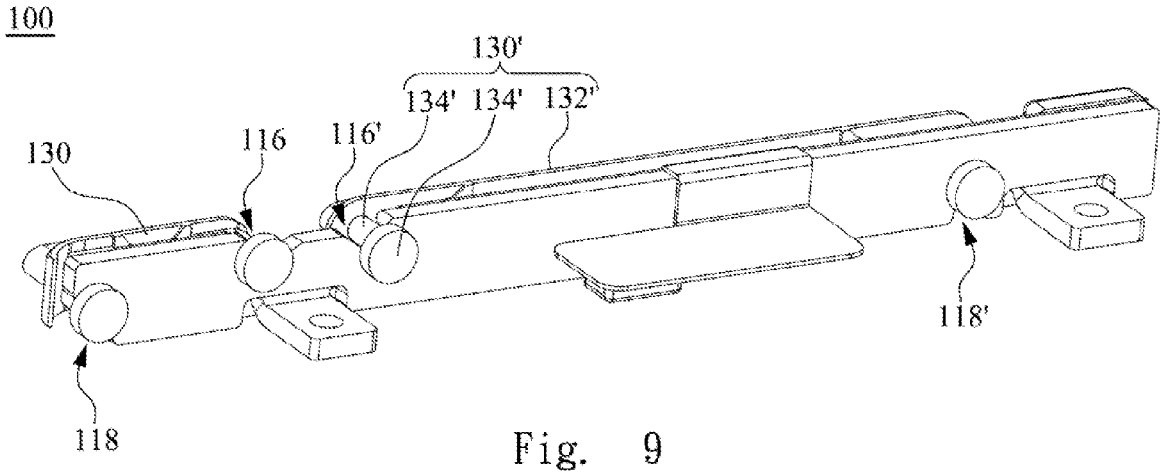
FIG. 9 is a perspective view of the other one of the two neck portions of the right-side button of FIG. 8 after being assembled to the second concave portion of the support bracket.

FIG. 8 is a perspective view of one of the two neck portions 134' of the right-side button 130' of FIG. 7 after being assembled to the first concave portion 116' of the support bracket 110. FIG. 9 is a perspective view of the other one of the two neck portion 134' of the right-side button 130' of FIG. 8 after being assembled to the second concave portion 118' of the support bracket 110. Referring both FIGS. 8 and 9, after the neck portion 134' located in the upper part of FIG. 8 is coupled to the first concave portion 116', the first concave portion 116' can be used as the pivot around which the button 130' pivots. At this time, the neck portion 134' located in the lower part of FIG. 8 may enter into the second concave 118' along a direction D6, such that the neck portion 134' located in the lower part of FIG. 8 is coupled to the second concave portion 118'.

Figure 10:
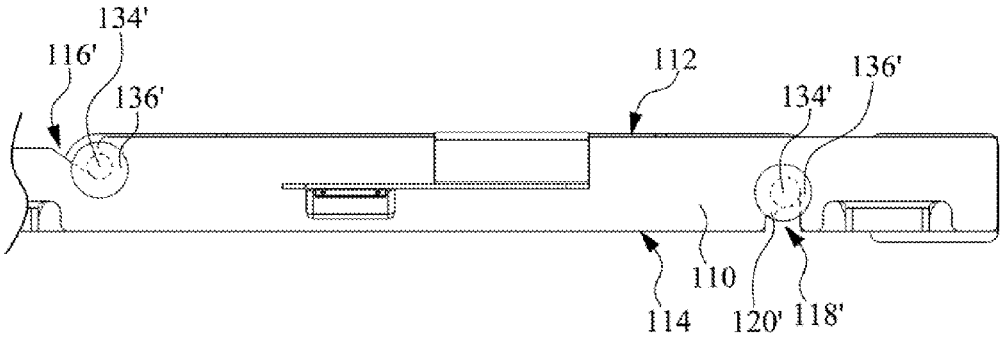
FIG. 10 is a schematic diagram wherein the two neck portions of FIG. 9 are respectively coupled to the first and second concave portions.

FIG. 10 is a schematic diagram wherein the two neck portions 134' of FIG. 9 are respectively coupled to the first and second concave portions 116', 118'. Referring both FIGS. 9 and 10, since the position limiting protruding point 120' protrudes from the second concave portion 118', the neck portion 134' coupled to the second concave portion 118' is positioned by the position limiting protruding point 120'. Therefore, the button 130' can be firmly assembled on the support bracket 110.

Figure 11:
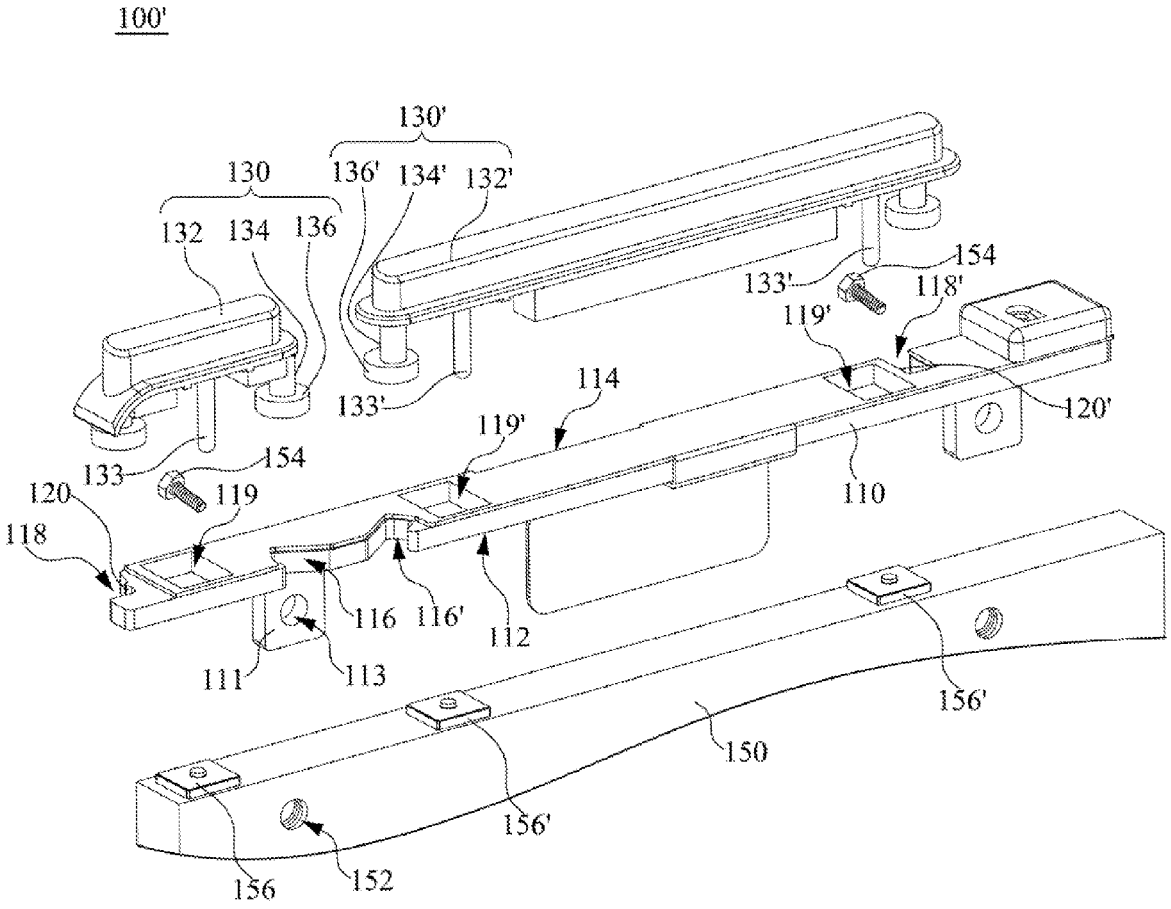
FIG. 11 is an exploded diagram of a button structure according to another embodiment of the invention.

FIG. 11 is an exploded diagram of a button structure 100' according to another embodiment of the invention. The button structure 100' includes the support bracket 110 and the buttons 130, 130'. The difference from the embodiment in FIG. 2 is that: the button structure 100' does not have the flexible printed circuit board but includes a printed circuit board 150. Furthermore, the support bracket 110 has hollow portions 119, 119'. The body portion 132 of the button 130 has a protruding portion 133. The body portion 132' of the button 130' has a protruding portion 133'.

The printed circuit board 150 has a fixing hole 152 which is aligned with the throughhole 113 of the fixing arm 111 so as to engage a fixing element 154 (e.g., the screw) into the fixing hole 152 (e.g., a screw hole). Therefore, the circuit 150 can be connected to the fixing arm 111. Moreover, the length direction of each of the protruding portions 133, 133' is in parallel with the length direction of each of the neck portions 134, 134'. The hollow portion 119 is located between the first and second concave portions 116, 118. The hollow portion 119' is located between the first and second concave portions 116', 118'. The body portion 132 of the button 130 has the protruding portion 133 which penetrates the hollow portion 119. The body portion 132' of the button 130' has the protruding portion 133' which penetrates the hollow portion 119'. The printed circuit board 150 has pressure sensitive elements 156, 156'. The pressure sensitive element 156 is aligned with the protruding portion 133, and the pressure sensitive element 156' is aligned with the protruding portion 133'. When the body portion 132 of the button 130 is pressed, the protruding portion 133 contacts the pressure sensitive element 156, such that the pressure sensitive element 156 transfers a pressure sensitive signal. When any end of the body portion 132' of the button 130' is pressed, the protruding portion 133' contacts the pressure sensitive element 156', such that the pressure sensitive element 156' transfers a pressure sensitive signal.

Compared with the prior art, the above embodiments of the invention have the following advantages.

(1) During assembly of the button structure, the button may be coupled to the first and second concave portions of the support bracket by the two neck portions, and the neck portion coupled to the second concave portion is positioned by the position limiting protruding point.

(2) When the two neck portions of the button are shaken by the external force in the first and second concave portions, the stop portion connected to the neck portion can abut against the support bracket, so as to avoid the button departing from the support bracket when being pressed.

(3) The button and the support bracket can be connected firmly without the hot melting process, such that the button can be precisely aligned with the pressure sensitive element. Therefore, the time and human cost can be reduced in assembly.

(4) After the button structure is used for a period of time, since no hot melting area is configured between the button and the support bracket, the button structure is not easy to be broken, so that the service life of the button structure can be lengthened.

Although the invention has been disclosed with reference to the above embodiments, these embodiments are not intended to limit the invention. It will be apparent to those of skills in the art that various modifications and variations can be made without departing from the spirit and scope of the invention. Thus, the scope of the invention should be defined by the appended claims.

What is claimed is:

1. A button structure, comprising:

a support bracket, having two opposite edges, a first concave portion, a second concave portion and a position limiting protruding point, wherein the first and second concave portions are respectively located at the two opposite edges, and the position limiting protruding point protrudes from the second concave portion, and the second concave portion has a slope surface, and the position limiting protruding point is located on the slope surface; and a button located on the support bracket, comprising:

a body portion;

two neck portions located on the opposite ends of the body portion, wherein the length direction of each of the two neck portions is perpendicular to the length direction of the body portion, and the two neck portions are respectively coupled to the first and second concave portions, wherein the neck portion coupled to the second concave portion is positioned by the position limiting protruding point; and two stop portions respectively connected to a side of the two neck portions facing away from the body portion, wherein the external diameter of each of the two stop portions is greater than the external diameter of the corresponding neck portion, such that the two stop portions abuts against the support bracket.

2. The button structure of claim 1, further comprising:

a flexible printed circuit board fixed on the support bracket, wherein the flexible printed circuit board has at least one pressure sensitive element located between the support bracket and the body portion of the button, and when the body portion of the button is pressed, the body portion contacts the pressure sensitive element, such that the pressure sensitive element transfers a pressure sensitive signal.

3. The button structure of claim 1, wherein the length of each of the two neck portions is greater than the thickness of the support bracket.

4. The button structure of claim 1, further comprising:

at least one elastomer located between the support bracket and the body portion of the button and located between the two neck portions.

5. The button structure of claim 4, wherein the elastomer comprises sponge, rubber or spring.

6. The button structure of claim 1, wherein the support bracket further comprises:

a fixing arm, wherein the length direction of the fixing arm is in parallel with the length direction of each of the two neck portions, and the fixing arm has a throughhole for penetration of a fixing element.

7. The button structure of claim 6, further comprising:

a printed circuit board connected to the fixing arm, wherein the printed circuit board has a fixing hole which is aligned with the throughhole of the fixing arm so as to engage the fixing element into the fixing hole.

8. The button structure of claim 7, wherein the support bracket has at least one hollow portion located between the first and second concave portions, the body portion of the button having at least one protruding portion which penetrates the hollow portion, the printed circuit board has at least one pressure sensitive element which is aligned with the protruding portion, and when the body portion of the button is pressed, the protruding portion contacts the pressure sensitive element, such that the pressure sensitive element transfers a pressure sensitive signal.

9. The button structure of claim 8, wherein the length direction of the protruding portion is in parallel with the length direction of each of the two neck portions.

* * * * *